US007944328B2

(12) United States Patent
Wu

(10) Patent No.: US 7,944,328 B2
(45) Date of Patent: May 17, 2011

(54) LOW-PASS FILTER

(75) Inventor: Chun-Te Wu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 202 days.

(21) Appl. No.: 12/430,841

(22) Filed: Apr. 27, 2009

(65) Prior Publication Data

US 2010/0109812 A1 May 6, 2010

(30) Foreign Application Priority Data

Oct. 31, 2008 (CN) ..... 2008 2 0302604 U

(51) Int. Cl.
*H01P 3/08* (2006.01)
*H01P 1/203* (2006.01)

(52) U.S. Cl. ..... 333/185; 333/204

(58) Field of Classification Search ..... 333/175, 333/185, 204, 219
See application file for complete search history.

(56) References Cited

U.S. PATENT DOCUMENTS

| | | | | |
|---|---|---|---|---|
| 5,786,303 | A | 7/1998 | Mansour | |
| 6,624,728 | B2 * | 9/2003 | Miyazaki et al. | 333/204 |
| 6,751,489 | B2 * | 6/2004 | Shen | 333/204 |
| 7,471,170 | B2 * | 12/2008 | Matters-Kammerer | 333/185 |
| 7,489,214 | B2 * | 2/2009 | Shih | 333/204 |

* cited by examiner

*Primary Examiner* — Seungsook Ham
(74) *Attorney, Agent, or Firm* — Frank R. Niranjan

(57) ABSTRACT

A low-pass filter includes a first curved microstrip, a second curved microstrip, a first flat microstrip, a second flat microstrip, and a third flat microstrip. The first curved microstrip is in an n-shape and defines a first receiving space therein. The second curved microstrip is in an n-shape and defines a second receiving space therein. The first flat microstrip is received in the first receiving space and connected to a topside of the n shape of the first curved microstrip. The second flat microstrip is received in the first receiving space along with the first flat microstrip and connected to one end of the first curved microstrip. The third flat microstrip is received in the second receiving space and connected to one end of the second curved microstrip.

7 Claims, 4 Drawing Sheets

LOW-PASS FILTER

BACKGROUND

1. Technical Field

Embodiments of the present disclosure relate to filters, and more particularly to a low-pass filter.

2. Description of Related Art

Filters are necessary high frequency components of wireless network devices and configured for isolating different frequencies, namely, passing some frequencies and stop the other. Without a filter, a wireless network device with the double data rate synchronous dynamic random access memory (DDR SDRAM) has electromagnetic interference (EMI). Therefore, most of such wireless network devices has some components for reducing noise and filtering EMI or has some little capacitors for filtering so as to filter higher harmonics over 1.4 GHz and improve electromagnetic compatibility.

However, the filtering effect of those components or capacitors is greatly influenced by the manufacture of those wireless network devices. Thus, a need exists to overcome the limitations described.

BRIEF DESCRIPTION OF THE DRAWINGS

The details of the disclosure, both as to its structure and operation, can best be understood by referring to the accompanying drawings, in which like reference numbers and designations refer to like elements.

DETAILED DESCRIPTION

Figure 1:
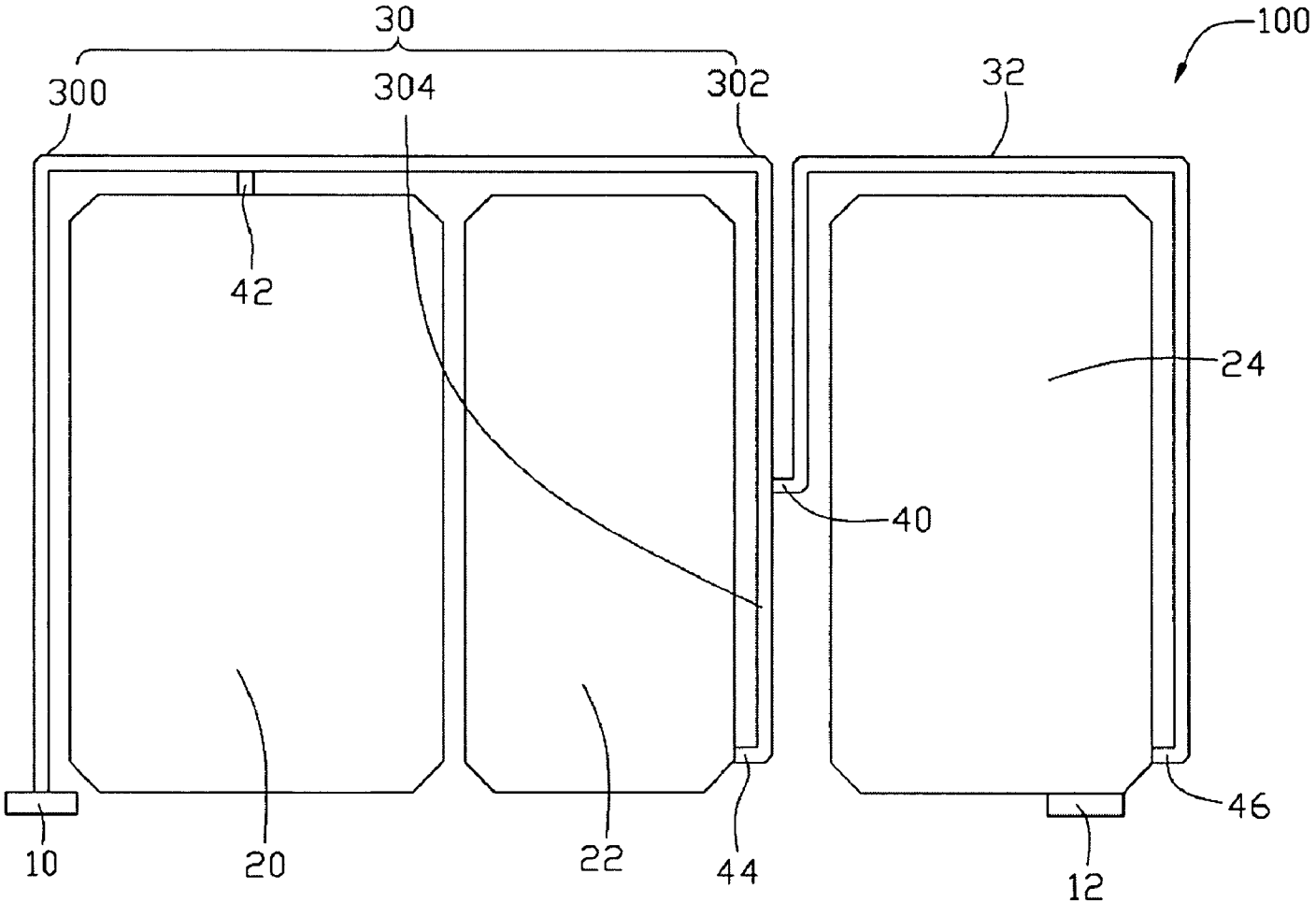
FIG. 1 is a schematic diagram of a low-pass filter of the disclosure.

FIG. 1 is a schematic diagram of a low-pass filter 100 of the present disclosure.

Here, the low-pass filter 100 includes a first curved microstrip 30, a second curved microstrip 32, a first flat microstrip 20, a second flat microstrip 22, and a third flat microstrip 24. Here, the low-pass filter 100 is formed by microstrips and printed on a board.

The first curved microstrip 30 is substantially n-shaped and defines a first receiving space therein. One end of the first curved microstrip 30 is defined as an input portion 10 of the low-pass filter 100. The input portion 10 is configured for inputting electromagnetic signals. The first curved microstrip 30 includes a first inductive microstrip 300 and a second inductive microstrip 302, and a third inductive microstrip 304. The first inductive microstrip 300 and the second inductive microstrip 302 are configured in two opposite L-shapes. The third inductive microstrip 304 is longitudinal.

The second curved microstrip 32 is substantially n-shaped and defines a second receiving space therein. Two opposite sides of the second curved microstrip 32 are parallel to those of the first curved microstrip 30. Topsides of the n-shapes of the first curved microstrip 30 and the second curved microstrip 32 are aligned. Here, the second curved microstrip 32 is configured in a substantially n shape with two unequal sides. One end of the shorter side of the second curved microstrip 32 is connected to the approximate midpoint of a side of the first curved microstrip 30 that is close to the second curved microstrip 32. Here, the second curved microstrip 32 is connected to the first curved microstrip 30 by way of a first connecting portion 40.

The first flat microstrip 20 is received in the first receiving space and connected to a topside of the n-shape of the first curved microstrip 30. Here, the first flat microstrip 20 is connected to the first curved microstrip 30 by way of a second connecting portion 42. Alternatively, the low-pass filter 100 may include a plurality of first flat microstrips 20.

The second flat microstrip 22 is received in the first receiving space along with the first flat microstrip 20 and connected to the other end of the first curved microstrip 30. Here, the second flat microstrip 22 is connected to the first curved microstrip 30 by way of a third connecting portion 44. Alternatively, the low-pass filter 100 may include a plurality of second flat microstrips 22.

The third flat microstrip 24 is received in the second receiving space and connected to the other end of the second curved microstrip 32. Here, the first flat microstrip 20, the second flat microstrip 22, and the third flat microstrip 24 are substantially disposed side by side. Top sides and bottom sides of the first flat microstrip 20, the second flat microstrip 22, and the third flat microstrip 24 are respectively aligned. Here, the third flat microstrip 24 is connected to the longer side of the second curved microstrip 32 by way of a fourth connecting portion 46. Alternatively, the low-pass filter 100 may include a plurality of third flat microstrips 24.

Here, the first flat microstrip 20, the second flat microstrip 22, and the third flat microstrip 24 are substantially rectangular, with physical centers thereof aligned. Alternatively, the first flat microstrip 20, the second flat microstrip 22, and the third flat microstrip 24 can be substantially round, with physical centers thereof again aligned. The first curved microstrip 30 and the second curved microstrip 32 are curved and respectively surround the first and second flat microstrip 20, 24 and the third flat microstrip 24.

The third flat microstrip 24 defines an output portion 12 of the low-pass filter 100. The output portion 12 is configured for outputting electromagnetic signals. Alternatively, the input portion 10 may be configured for outputting electromagnetic signals and the output portion 12 may be configured for inputting electromagnetic signals.

Figure 2:
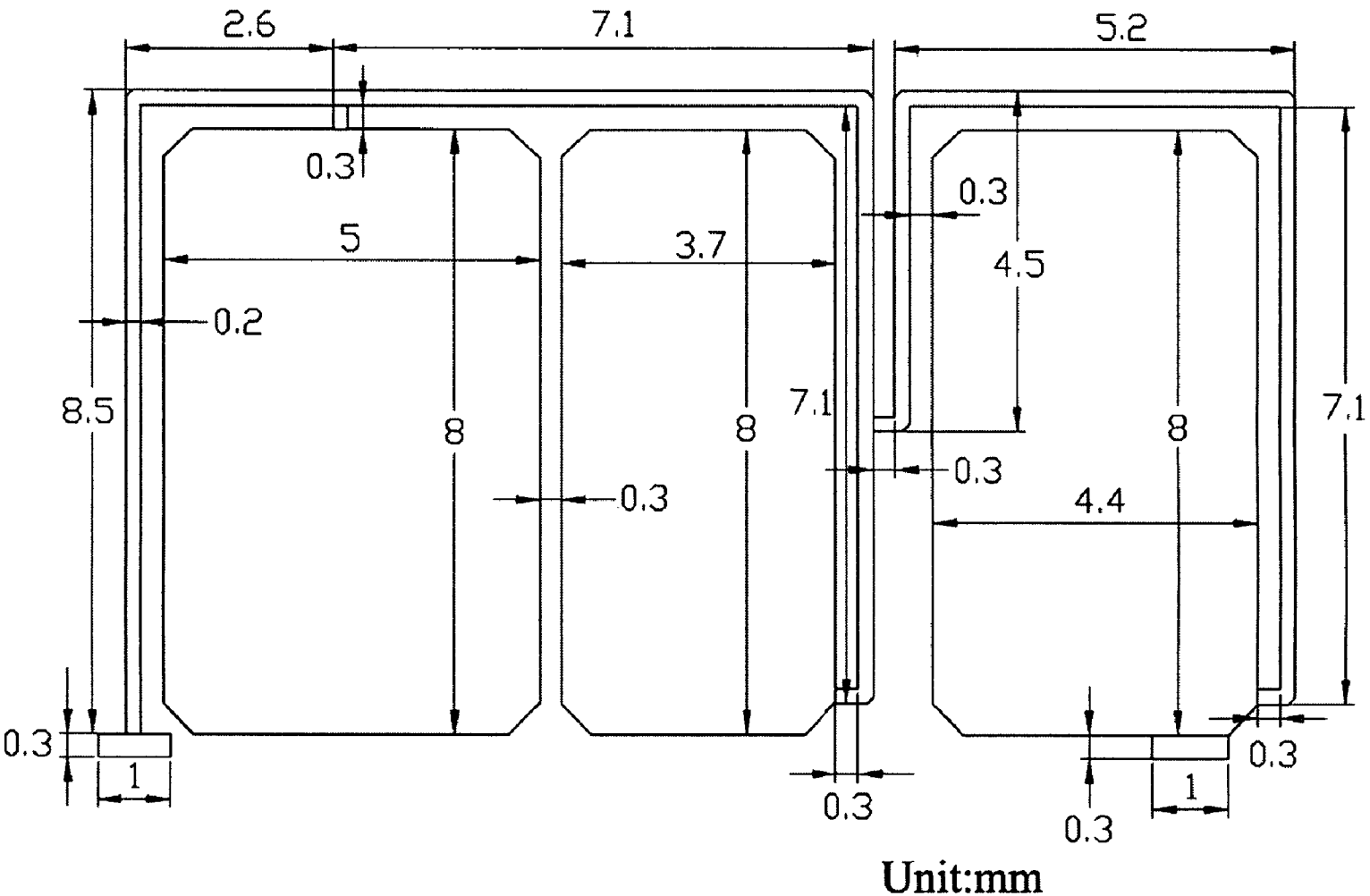
FIG. 2 shows the dimension of the low-pass filter of FIG. 1.

FIG. 2 shows the dimension of the low-pass filter of FIG. 1. Here, the low-pass filter 100 has a substantial length of 15.8 mm and a substantial width of 8.8 mm. In detail, the input portion 10 and the output portion 12 both have substantial lengths of 1 mm and substantial widths of 0.3 mm. The first curved microstrip 30 and the second curved microstrip 32 have a substantial width of 0.2 mm. The topside of the first curved microstrip 30 has a substantial length of 9.7 mm. The side of the first curved microstrip 30, defined as the input portion 10, has a substantial length of 8.5 mm and the other side of the first curved microstrip 30 has a substantial length of 7.1 mm. The topside of the second curved microstrip 32 has a substantial length of 5.2 mm. The side of the second curved microstrip 32, connected to the first curved microstrip 30, has a substantial length of 4.5 mm and the other side of the second curved microstrip 32 has a substantial length of 7.1 mm. Lateral distances from the first connecting portion 42 to two sides of first curved microstrip 30 are respectively substantially 2.6 mm and 7.1 mm. The first flat microstrip 20 and the second flat microstrip 22 both have substantial lengths of 5 mm and a substantial width of 8 mm. Lateral distance of two neighboring sides of the first flat microstrip 20 and the second flat microstrip 22 is substantially 0.3 mm. The third flat microstrip 24 has a substantial length of 4.4 mm and a substantial width of 8 mm.

Figure 3:
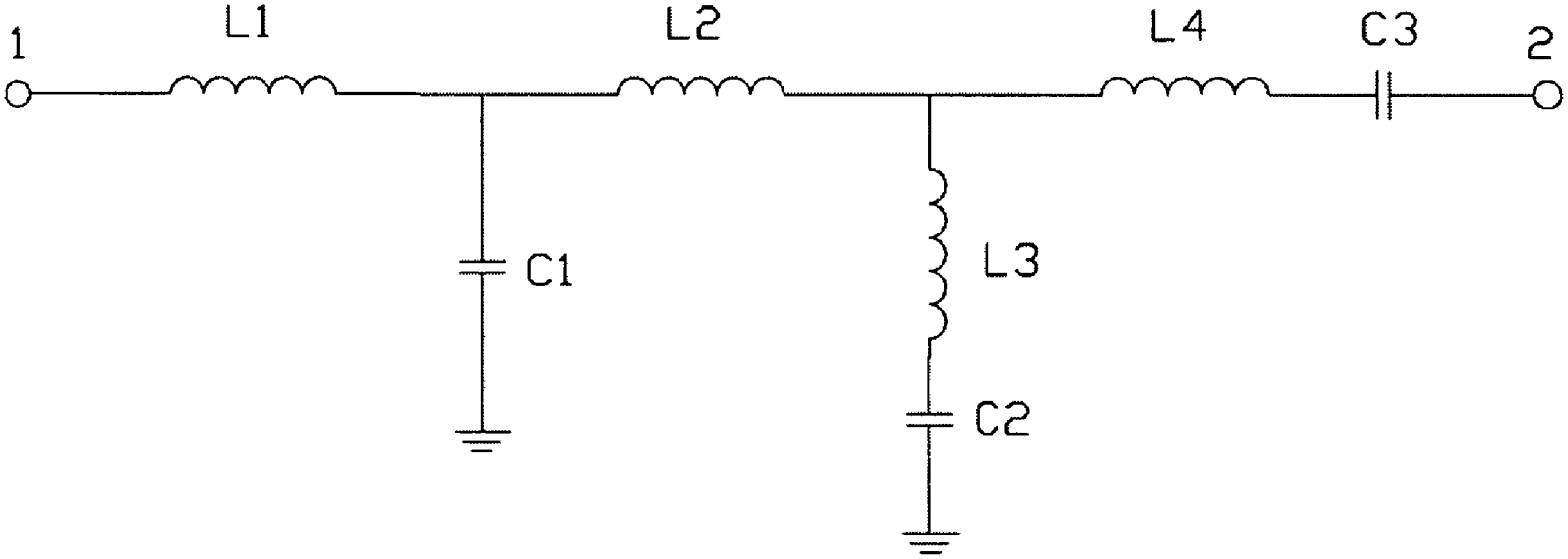
FIG. 3 is a equivalent circuit diagram of the low-pass filter of FIG. 1.

FIG. 3 is a equivalent circuit diagram of the low-pass filter 100 of FIG. 1. Here, the first and second curved microstrips act as inductors. The first curved microstrip 30 relates to a first inductor L1, a second inductor L2, and a third inductor L3. The second curved microstrip 32 relates to a fourth inductor L4. The first, second and third flat microstrips act as capacitors and respectively relate to a first conductor C1, a second conductor C2, and a third conductor C3. An end 1 and an end 2 respectively relate to the input portion 10 and the output portion 12.

Figure 4:
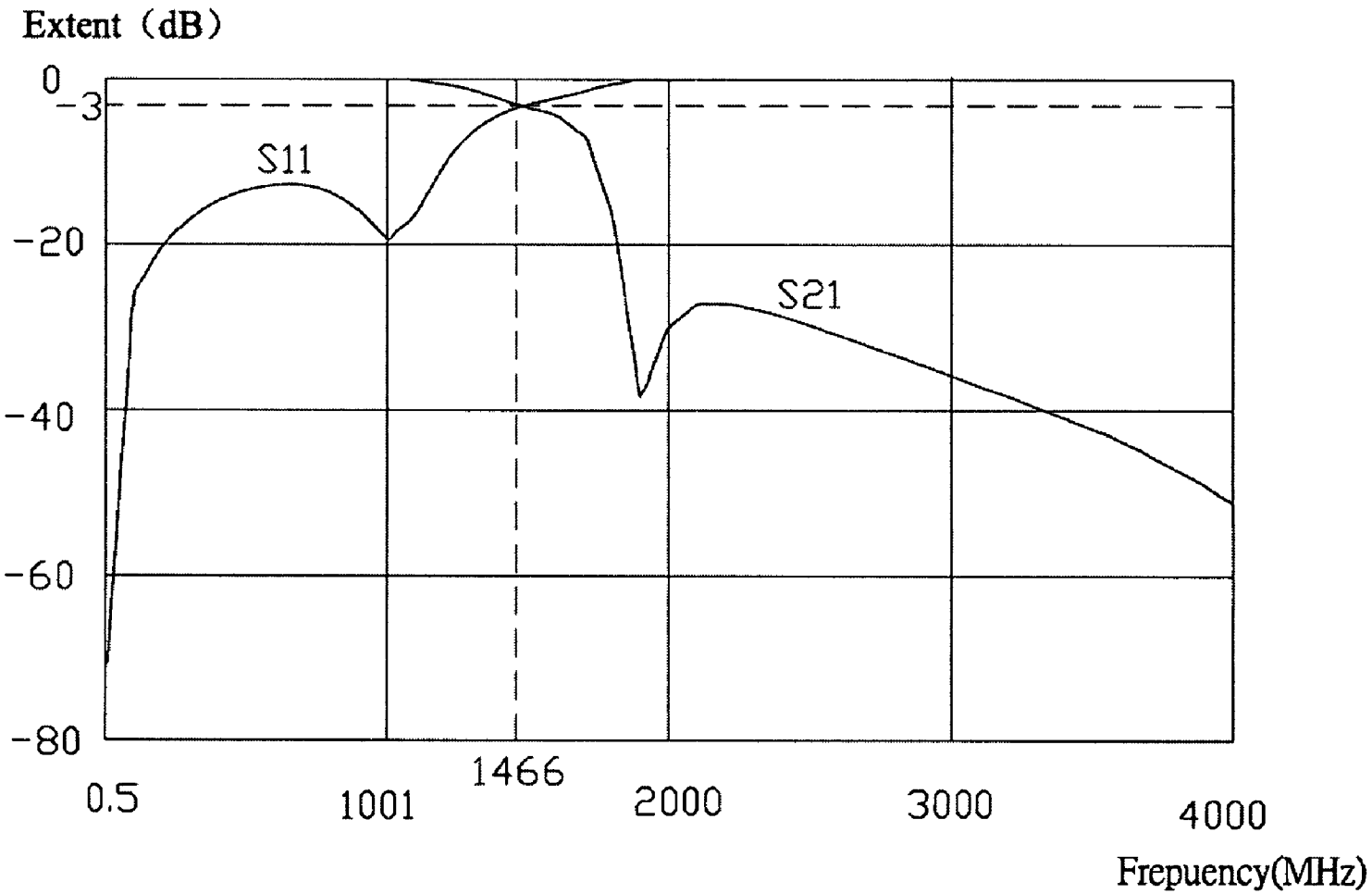
FIG. 4 is a diagram showing a relationship between insertion or return loss and frequency of electromagnetic signals through the low-pass filter of FIG. 1.

FIG. 4 is a diagram showing a relationship between insertion or return loss and frequency of electromagnetic signals through the low-pass filter 100 of FIG. 1. The horizontal abscissa represents frequency (in GHz), and the vertical ordinate represents the insertion or return loss (in dB) of the low-pass filter 100.

When the electromagnetic signals travel through the low-pass filter 100, a part of the input power is returned to a source of the electromagnetic signals, a part referred to as return loss. The return loss of an electromagnetic signal through the low-pass filter 100 is indicated by the curve labeled S11 and indicates a relationship between the input power and the return power of the electromagnetic signal through the low-pass filter 100, and is represented by the following: S11(dB) $=-20*\mathrm{Log}_{10}$ [(Return Voltage)/(Input Voltage)].

The insertion loss of an electromagnetic signal through the low-pass filter 100 is indicated by the curve labeled S21 and indicates a relationship between input power and output power of the electromagnetic signals traveling through the low-pass filter 10, and is represented by the following: S21 (dB)$=-20*\mathrm{Log}_{10}$ [(Output Voltage)/(Input Voltage)].

For a filter, when the output power of the electromagnetic signal in a low-pass filter frequency range is close to the input power thereof, and the return power of the electromagnetic signal is low, distortion of the electromagnetic signal is correspondingly low and performance of the low-pass filter good. That is, with reduced absolute value of the insertion loss of the electromagnetic signal, absolute value of the return loss increases, filter performance of the filter improving correspondingly. As shown in FIG. 4, the insertion loss of the electromagnetic signal in substantial 1.4 GHz is close to 0 dB, and 1466 MHz is close to −3 dB. The return loss of the electromagnetic signal in the low-pass frequency range is less than −3 dB, and accordingly all the electromagnetic signals in the low-pass frequency range can pass the low-pass filter 100. The insertion loss of the electromagnetic signal beyond the band-pass frequency range is close to 0 dB, and accordingly all the electromagnetic signals beyond the low-pass frequency range are filtered by the low-pass filter 100. Therefore, the low-pass filter 100 can filter the electromagnetic signals over 1.4 GHz.

In addition, the low-pass filter 100 disclosed by the present disclosure is made of microstrips and printed in the board, which greatly reduces an influence to filtering effect caused by the manufacture of the low-pass filter 100.

Although the features and elements of the present disclosure are described as embodiments in particular combinations, each feature or element can be used alone or in other various combinations within the principles of the disclosure to the full extent indicated by the broad general meaning of the terms in which the appended claims are expressed.

What is claimed is:

1. A low-pass filter comprising:

a first curved microstrip in an n-shape and defining a first receiving space therein, wherein one end of the first curved microstrip is defined as an input portion of the low-pass filter;

a second curved microstrip in an n-shape and defining a second receiving space therein, wherein two opposite sides of the second curved microstrip are parallel to those of the first curved microstrip, and one end of the second curved microstrip is connected to a side of the first curved microstrip close to the second curved microstrip;

a first flat microstrip, received in the first receiving space, and connected to a topside of the n shape of the first curved microstrip;

a second flat microstrip, received in the first receiving space along with the first flat microstrip, and connected to the other end of the first curved microstrip; and a third flat microstrip, received in the second receiving space, and connected to the other end of the second curved microstrip;

wherein the third flat microstrip defines an output portion of the low-pass filter.

2. The low-pass filter as claimed in claim 1, wherein the first and second curved microstrips act as inductors.

3. The low-pass filter as claimed in claim 2, wherein the first, second and third flat microstrips act as capacitors.

4. The low-pass filter as claimed in claim 1, wherein topsides of the n-shapes of the first curved microstrip and the second curved microstrip are aligned.

5. The low-pass filter as claimed in claim 4, wherein the second curved microstrip is connected to a substantial center of the side of the first curved microstrip which is close to the second curved microstrip.

6. The low-pass filter as claimed in claim 1, wherein the first flat microstrip, the second flat microstrip, and the third flat microstrip are substantially rectangular, with physical centers thereof aligned.

7. The low-pass filter as claimed in claim 1, wherein the first flat microstrip, the second flat microstrip, and the third flat microstrip are substantially round, with physical centers thereof aligned.

* * * * *